US011414768B1

(12) United States Patent
Zhang

(10) Patent No.: US 11,414,768 B1
(45) Date of Patent: Aug. 16, 2022

(54) METHOD FOR PREPARING COMPOUND WITH SPIRO[5.5] MOLECULAR SKELETON BY ELECTROOXIDATION

(71) Applicant: Zhejiang Normal University, Jinhua (CN)

(72) Inventor: Yan Zhang, Jinhua (CN)

(73) Assignee: ZHEJIANG NORMAL UNIVERSITY, Jinhua (CN)

( * ) Notice: Subject to any disclaimer, the term of this patent is extended or adjusted under 35 U.S.C. 154(b) by 0 days.

(21) Appl. No.: 17/684,762

(22) Filed: Mar. 2, 2022

(30) Foreign Application Priority Data

Mar. 23, 2021 (CN) ..... 202110309275.3

(51) Int. Cl.

| | |
|---|---|
| ***C25B 3/07*** | (2021.01) |
| ***C25B 3/11*** | (2021.01) |
| ***C25B 3/23*** | (2021.01) |
| ***C25B 11/043*** | (2021.01) |

(52) U.S. Cl.
CPC ..... *C25B 3/23* (2021.01); *C25B 3/07* (2021.01); *C25B 3/11* (2021.01); *C25B 11/043* (2021.01)

(58) Field of Classification Search
CPC ..... C25B 3/07; C25B 3/11; C25B 3/23
USPC ..... 205/447, 456, 461, 463
See application file for complete search history.

(56) References Cited

PUBLICATIONS

Yu et al., "Electrochemical Oxidative Halogenation of N-Aryl Alkynamides for the Synthesis of Spiro[4.5]trienones," The Journal of Organic Chemistry (Dec. 7, 2020), vol. 86, No. 1, pp. 917-928. (Year: 2020).*

Yan Zhang, Junhua Zhang, Boyue Hu, Mingming Ji, Shangyi Ye, and Gangguo Zhu, "Synthesis of Difluoromethylated and Phosphorated Spiro[5.5]trienones via Dearomative Spirocyclization of Biaryl Ynones", American Chemical Society Orgnic Letters, May 8, 2018, pp. 2988-2992, vol. 20.

* cited by examiner

*Primary Examiner* — Edna Wong
(74) *Attorney, Agent, or Firm* — WPAT, PC

(57) ABSTRACT

A method for preparing a compound with a spiro[5.5] molecular skeleton by electrooxidation is provided, which relates to the field of organic synthesis technology. Specifically, the method includes o-alkynyl benzoyl biphenyl reacts with sodium fluoromethylsulfite in an electrolyte and a solvent under a current condition to obtain the compound with the spiro[5.5] molecular skeleton. The method uses cheap $CF_3$ (trifluoromethyl) free radical and electrooxidation to realize the de-aromatization of biphenyl without catalyst. The reaction can occur only under the action of current, which is energy-saving and economical. The free radical used in the reaction is cheap, easy to obtain and low cost. The reaction device is simple and easy to operate, and the yield of the reaction is as high as 60%.

8 Claims, 7 Drawing Sheets

METHOD FOR PREPARING COMPOUND WITH SPIRO[5.5] MOLECULAR SKELETON BY ELECTROOXIDATION

TECHNICAL FIELD

The disclosure relates to the field of organic synthesis technologies, and more particularly to a method for preparing a compound with a spiro[5.5] molecular skeleton by electrooxidation.

BACKGROUND

De-aromatization of biphenyl is a new and important research topic, especially for the synthesis of spiro compounds with novel substitution characteristics. In recent years, the rapid development of free radical chemistry has opened up a new path for the synthesis of new substituted spiro compounds. Previously, under the catalysis of transition metal salts (e.g., $AgNO_3$ and $Cu_2O$), the existing technology realized the reaction of o-alkynyl benzoyl biphenyl and difluoroalkyl to construct the spiro[5.5] molecular skeleton, and successfully introduced a difluoro group into the spiro[5.5] structure to screen out new functional small molecules. The reaction mechanism is as follows (Reference: Yan Zhang et al., "*Synthesis of Difluoromethylated and Phosphorated Spiro*[5.5]*trienones via Dearomative Spirocyclization of Biaryl Ynones*", *American Chemical Society Orgnic Letters*, May 8, 2018, pp. 2988-2992, Vol. 20.):

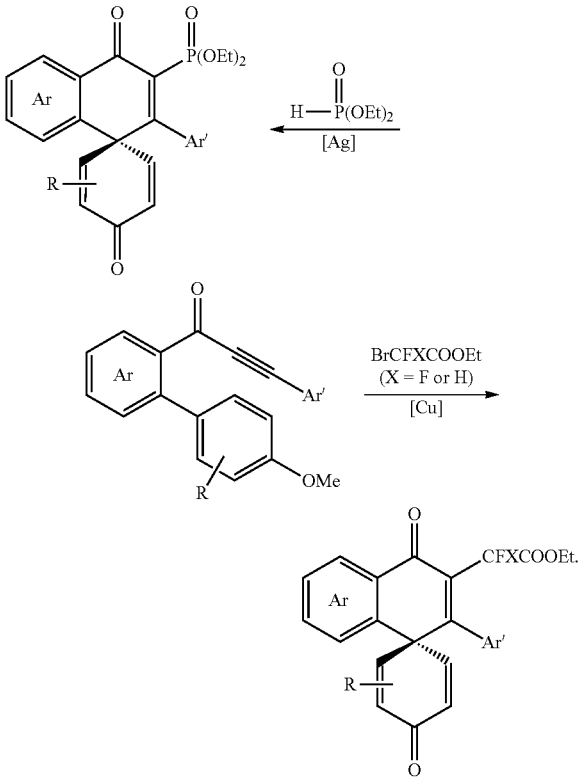

However, the above reaction needs to use transition metals as catalysts to trigger the production of free radicals, which has high reaction cost and low environmental friendliness, and do not enable the synthesis of direct trifluoromethyl-substituted spirocyclic products or difluoromethyl-substituted spirocyclic products. Therefore, the development of trifluoromethyl-substituted spiro[5.5] products obtained by radical cyclization is essential.

SUMMARY

In order to solve the above technical problems, the disclosure provides a method for preparing a compound with a spiro[5.5] molecular skeleton. The method uses cheap trifluoromethyl ($CF_3$) radical to realize the de-aromatization of biphenyl by electrooxidation without catalyst.

The disclosure realizes the technical purpose through the following solutions. Specifically, a method for preparing a compound with a spiro[5.5] molecular skeleton by electrooxidation includes the following steps: reacting o-alkynyl benzoyl biphenyl with sodium fluoromethylsulfite in an electrolyte and a solvent under a current condition to thereby obtain the compound with the spiro[5.5] molecular skeleton.

Under a condition of the constant current and the electrolyte, the substituted o-alkynyl benzoyl biphenyl reacts with the sodium fluoromethylsulfite in the solvent. In a process of the reacting, a fluoromethylsulfite ion first is oxidized at an anode and loses an electron to form a fluoromethyl radical A. The free radical A attacks alkynyl at carbon position a of a carbonyl of biphenyl, thereby generating a more thermodynamically a stable free radical B. Then, the free radical B hits a benzene ring and forms a more stable new radical C through 6-exo-trig cyclization. The new radical C loses another electron to form a carbon positive ion D, then the electron in the carbon positive ion D is transferred to form E, and the E is dehydrogenated and demethylated at a cathode to obtain the compound with the spiro [5.5] molecular skeleton. A specific reaction mechanism is shown in FIG. 1.

In an embodiment, a structural formula of the o-alkynyl benzoyl biphenyl is shown in a formula (I), and a structural formula of the sodium fluoromethylsulfite is shown in a formula (II);

(I)

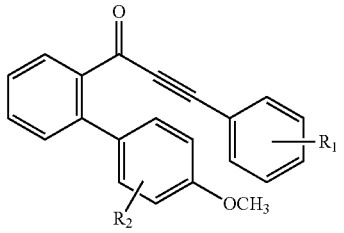

(II)

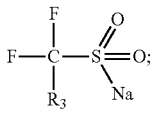

where in the formula (I), R1 is one of an electron-withdrawing group and an electron-donating group, R2 is one of a methyl group and a methoxy group; and in the formula (II), R3 is one of a hydrogen group and a fluorine group.

In an embodiment, the electron-withdrawing group is one selected from a group consisting of a hydrogen group, a nitro group, halogen groups, a cyano group, an acyl group and a carboxyl group; and the electron-donating group is one selected from a group consisting of a hydrogen group, an amino group, a methyl group and a methoxy group.

In an embodiment, substitution positions of the R1 are any two or more positions selected from a group consisting of positions 2, 3, 4, 5 and 6 of a benzene ring; and substitution positions of R2 is at positions 3 and 5 of another benzene ring.

In an embodiment, the electrolyte is one selected from a group consisting of tetrabutyl ammonium tetrafluoroborate ($C_{16}H_{36}BF_4N$), lithium tert-butoxide ($C_4H_9LiO$), tetrabutylammonium periodate ($C_{16}H_{36}INO_4$), N,N,N-triethylethanaminium perchlorate ($C_8H_{20}ClNO_4$), tetraethylammonium hexafluorophosphate ($C_8H_{20}F_6NP$) and tetrabutylammonium perchlorate ($C_{16}H_{36}ClNO_4$), and a concentration of the electrolyte in the solvent is in a range of 0.05~1 mole per liter (mol/L); and a molar ratio of the o-alkyne benzoyl biphenyl to the sodium fluoromethylsulfite is 1:3.

In an embodiment, the electrolyte is the N,N,N-triethylethanaminium perchlorate, a concentration of the N,N,N-triethylethanaminium perchlorate in the solvent is 0.1 mol/L, and the solvent is a mixture of the dichloroethane and the acetonitrile with a volume ratio of 1:1. The mixture is more suitable for the reacting in terms of solubility and polarity.

In an embodiment, a reaction condition of the reacting the o-alkynyl benzoyl biphenyl with the sodium fluoromethylsulfite in the electrolyte and the solvent under the current condition are as follows: graphite felt as an anode material, a platinum sheet or a nickel foam as a cathode material, a constant current in a range of 3~10 milliamperes (mA), a reaction temperature in a range of 25~70° C., and a reaction time in a range of 7~11 hours.

Too high or too low reaction temperature will reduce a conversion rate of reactants, and too high reaction temperature will lead to undesired side reactions such as free radical self-coupling reactions, resulting in lower product yields.

In an embodiment, the reaction condition are specifically as follows: the graphite felt as the anode material, the platinum sheet as the cathode material, the constant current of 4 mA, the reaction temperature of 45° C., and the reaction time of 8 hours.

In an embodiment, the reacting is carried out in an open system without a catalyst to avoid excessive pressure or explosion hazard caused by an accumulation of hydrogen generated at the cathode.

In the disclosure, a compound containing spiro[5.5] molecular skeleton is generated by using the sodium fluoromethylsulfite and the substituted biphenyl in the electrolyte under the promotion of electricity. A reaction formula is as follows:

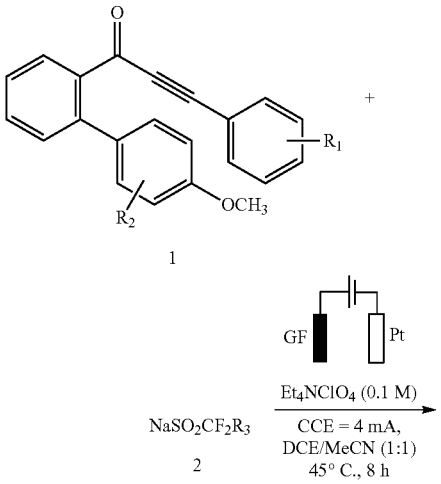

-continued

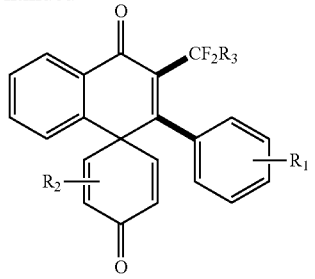

3a

Compared with the related art, the embodiments of the disclosure may mainly have the following beneficial effects.

The reaction of the disclosure does not need transition metal catalyst and can occur only under the action of current, which is energy-saving and economical. The free radical source used in the reaction is cheap, and easily available, and the cost is low. The reaction device is simple and easy to operate. The yield of the reaction is as high as 60%. The spiro compounds prepared by this method are expected to be used in the field of pharmaceutical chemistry to prepare bioactive molecules with similar structural skeleton.

DETAILED DESCRIPTION OF EMBODIMENTS

Figure 1:
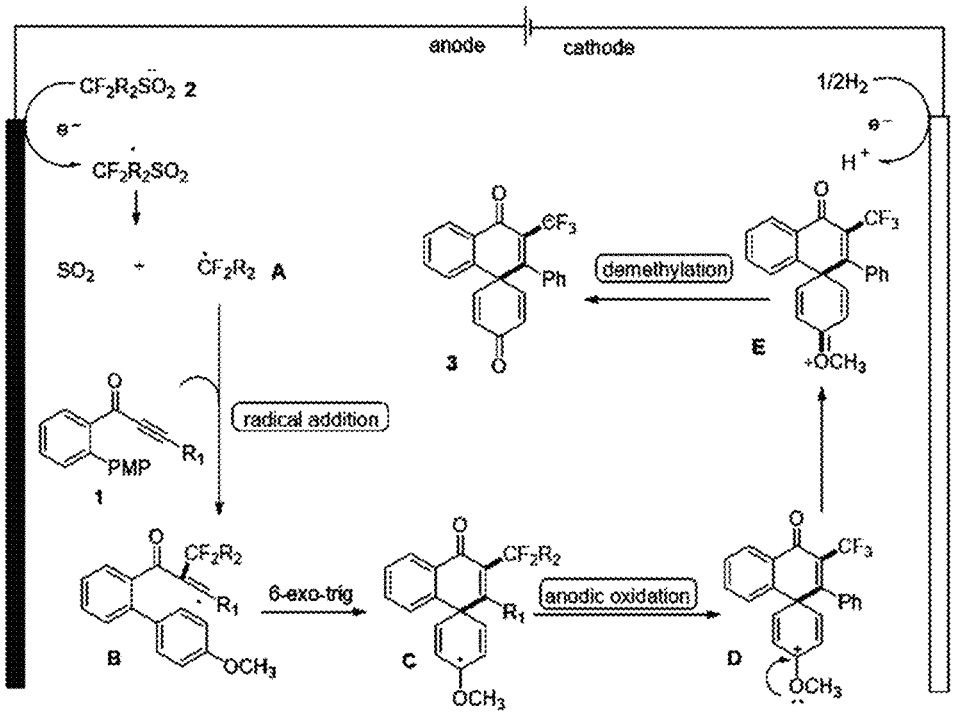
FIG. 1 is a schematic diagram of a reaction mechanism of the disclosure.

Various exemplary embodiments of the disclosure are described in detail. The detailed description should not be considered as a limitation of the disclosure, but should be understood as a more detailed description of some aspects, characteristics and embodiments of the disclosure.

It should be understood that the terms described in the disclosure are only for describing special embodiments and are not used to limit the disclosure. In addition, for the numerical range in the disclosure, it should be understood that each intermediate value between upper and lower limits of the numerical range is also specifically disclosed. Each smaller range between any stated value or intermediate value within the numerical range and any other stated value or intermediate value within the numerical range is also included in the disclosure. The upper and lower limits of these smaller ranges can be independently included or excluded from the numerical range.

Unless otherwise specified, all technical and scientific terms used herein have the same meanings generally understood by those skilled in the art of the disclosure. Although the disclosure only describes the illustrated methods and materials, any methods and materials similar or equivalent to those described herein may also be used in the implementation or testing of the disclosure. All documents mentioned in this specification are incorporated by reference to disclose and describe methods and/or materials related to the documents. In case of conflict with any incorporated literature, the contents of this specification shall prevail.

It will be apparent to those skilled in the art that various improvements and changes can be made to the specific embodiment of the description of the disclosure without departing from the scope or spirit of the disclosure. Other embodiments obtained from the description of the disclosure will be apparent to those skilled in the art. The description and embodiments of the disclosure are only exemplary.

The terms "include", "comprise", "have", "contain", etc., as used herein, are open-ended terms, meaning including but not limited to.

Embodiment 1

In a reaction tube, biphenyl compound 1a (93.6 micrograms (mg), 0.3 micromoles (mmol), 1.0 equivalent (equiv.)), $NaSO_2CF_3$ 2a (140.4 mg, 0.9 mmol, 3.0 equiv.) and $EtNClO_4$ (92 mg, 0.4 mmol, 1.3 equiv.) are accurately added and dissolved into a mixed solvent dichloroethane (DCE)/acetonitrile (MeCN) (volume/volume (v/v): 1:1, 4 milliliters (mL)) to thereby obtain a mixed solution. An anode is graphite felt (GF) with an electrode size of 10 millimeters (mm)×15 mm×6 mm, and a cathode is a platinum sheet with an electrode size of 10 mm×15 mm×0.25 mm. An electro-oxidation reaction is carried out at 45° C. and a current is kept at 4 milliamperes (mA) for 8 hours.

The mixed solution after the electro-oxidation reaction is transferred into a round bottom flask. Silicon dioxide is added into the round bottom flask and the solvent is evaporated in vacuo to obtain an evaporated product. Using petroleum ether (PE)/ethyl acetate (EA) (v/v: 5:1) as an eluent, the evaporated product is purified by silica gel column chromatography to obtain a corresponding product 3aa with a yield of 60%. A reaction formula is as follows:

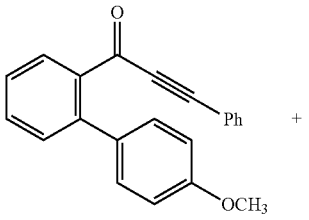

1a

-continued

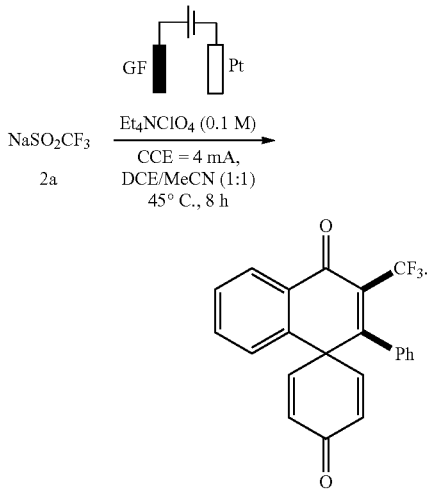

3aa

Figure 2:
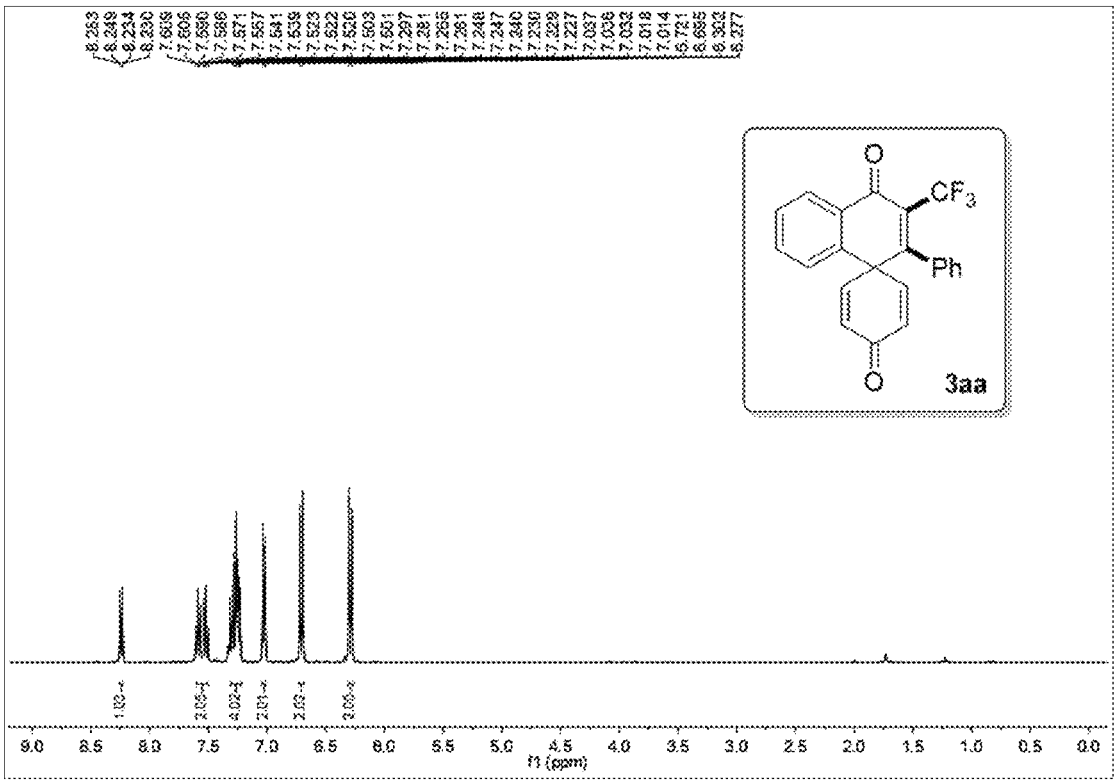
FIG. 2 is a proton nuclear magnetic resonance ($^1$H NMR) spectrum diagram of a product prepared in embodiment 1 of the disclosure.
Figure 3:
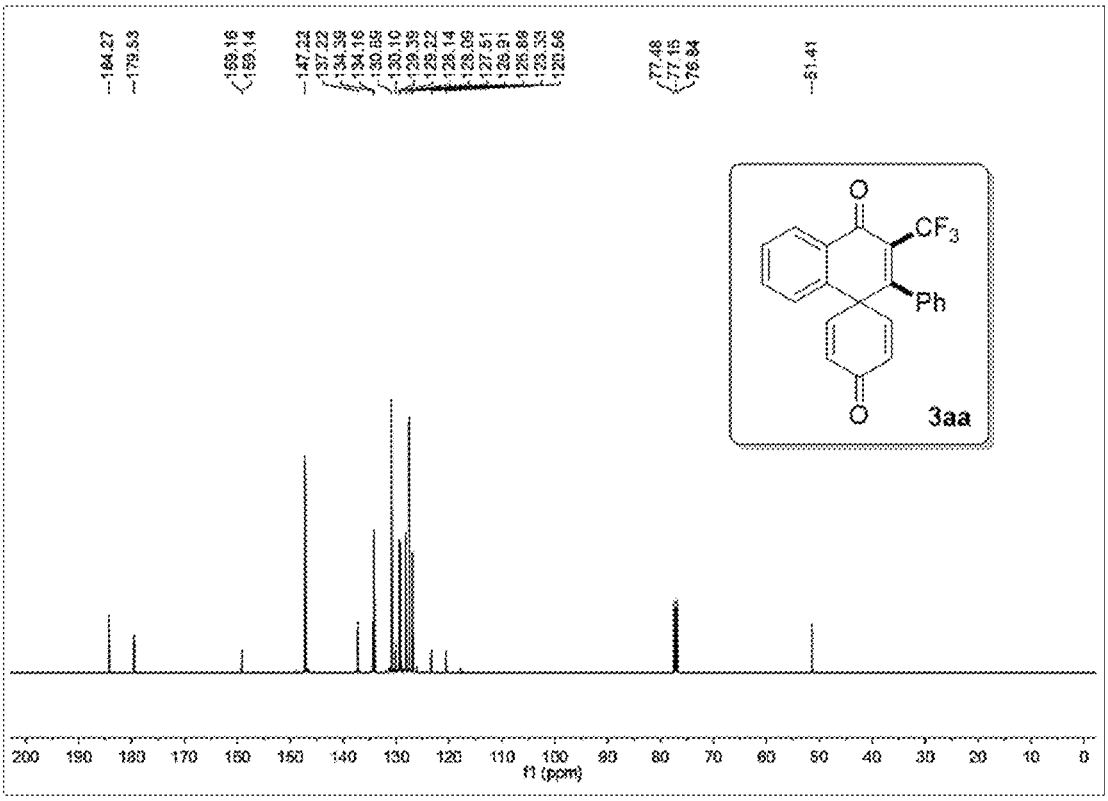
FIG. 3 is a carbon-13 ($^{13}$C) NMR spectrum diagram of the product prepared in the embodiment 1 of the disclosure.
Figure 4:
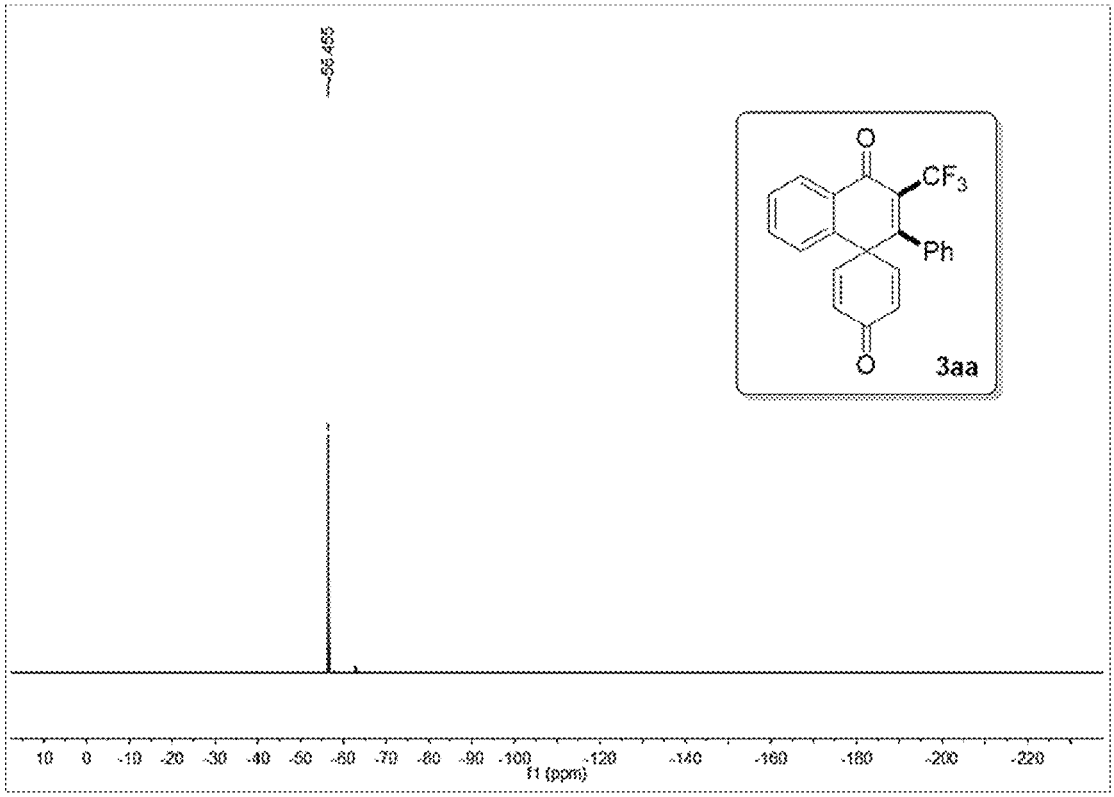
FIG. 4 is a Fluorine-19 ($^{19}$F) NMR spectrum diagram of the product prepared in embodiment 1 of the disclosure.
Figure 5:
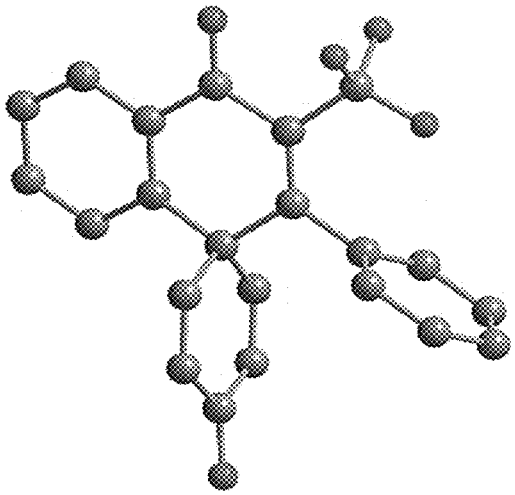
FIG. 5 is an X-ray single crystal diagram of the product prepared in embodiment 1 of the disclosure.

A proton nuclear magnetic resonance ($^1$H NMR) spectrum diagram of the product is shown in FIG. 2, a carbon-13 ($^{13}$C) NMR spectrum diagram of the product is shown in FIG. 3, a Fluorine-19 ($^{19}$F) NMR spectrum diagram of the product is shown in FIG. 4, and an X-ray single crystal diagram of the product is shown in FIG. 5. Product NMR data: $^1$H NMR (400 megahertzes (MHz)), δ: 8.24 (d, J=7.6 Hz, 1H), 7.61-7.50 (m, 2H), 7.32-7.23 (m, 4H), 7.01-7.01 (m, 2H), 6.71 (d, J=10.0 Hz, 2H), 6.29 (d, J=10.4 Hz, 2H); $^{13}$C NMR (100 MHz), δ: 184.3, 179.5, 159.1 (q, J=2.2 Hz), 147.2, 137.2, 134.4, 134.2, 130.9, 130.1, 129.4, 129.2, 128.9, 128.1, 128.09, 127.5, 126.9 (q, J=1.8 Hz), 121.9 (q, J=276.2 Hz), 51.4; and $^{19}$F (376.6 Hz): −56.45.

Embodiment 2

In a reaction tube, biphenyl compound 1b (102.6 mg, 0.3 mmol, 1.0 equiv.), $NaSO_2CF_3$ 2a (140.4 mg, 0.9 mmol, 3.0 equiv.), and $EtNClO_4$ (92 mg, 0.4 mmol, 1.3 equiv.) are accurately added and dissolved in in a mixed solvent DCE/MeCN (v/v: 1:1, 4 mL) to thereby obtain a mixed solution. An anode is GF with an electrode size of 10 mm×15 mm×6 mm, and a cathode is a platinum sheet electrode with an electrode size of 10 mm×15 mm×0.25 mm. An electro-oxidation reaction is carried out at 45° C. and a current is kept at 4 mA for 8 hours. The mixed solution after the electro-oxidation reaction is transferred into a round bottom flask. Silicon dioxide is added into the round bottom flask and the solvent is evaporated in vacuo to obtain an evaporated product. Using PE/EA (v/v: 5:1) as an eluent, the evaporated product is purified by silica gel column chromatography to obtain a corresponding product 3ba with a yield of 62%. A reaction formula is as follows (where PMP is p-methoxyphenyl):

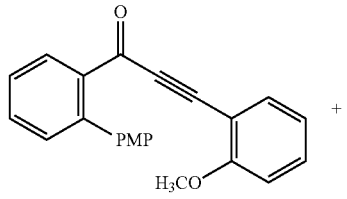

1b

-continued

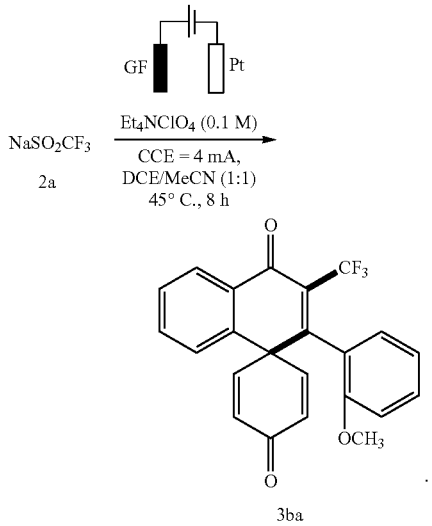

Figure 6:
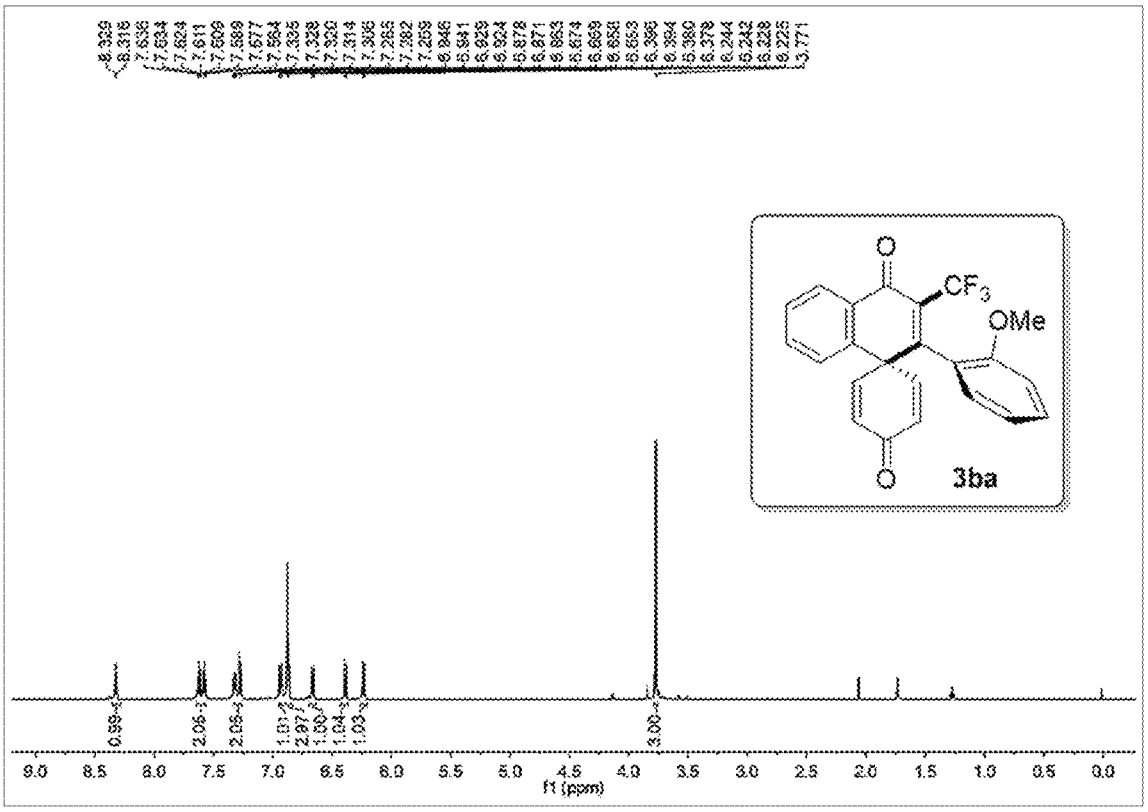
FIG. 6 is a $^1$H NMR spectrum diagram of a product prepared in embodiment 2 of the disclosure.
Figure 7:
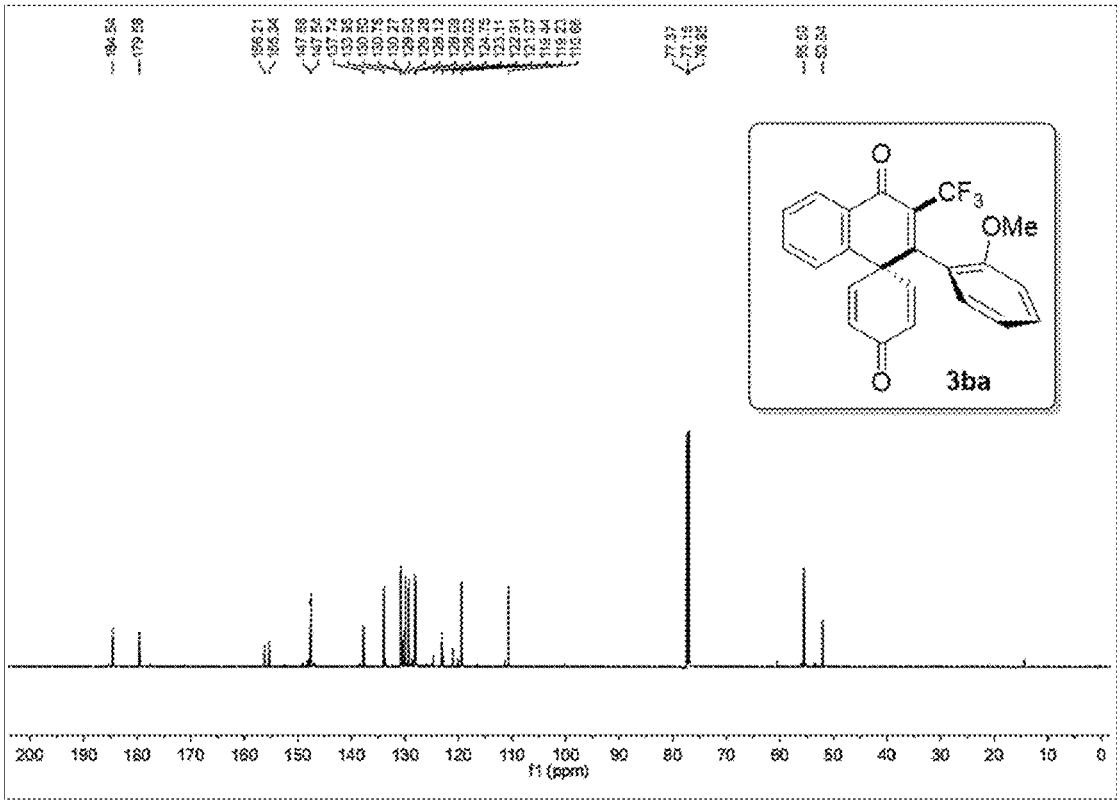
FIG. 7 is a $^{13}$C NMR spectrum diagram of the product prepared in embodiment 2 of the disclosure.
Figure 8:
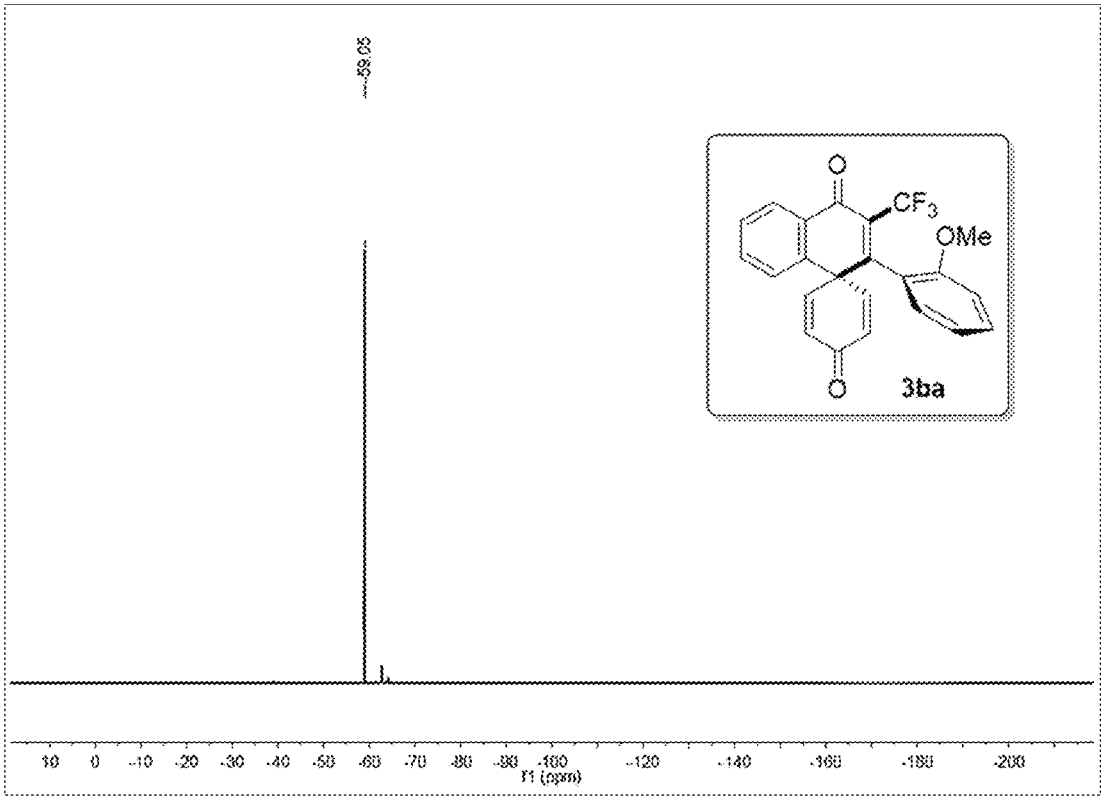
FIG. 8 is a $^{19}$F NMR spectrum diagram of the product prepared in embodiment 2 of the disclosure.

A $^1$H NMR spectrum diagram of the product is shown in FIG. 6, a $^{13}$C NMR spectrum diagram of the product is shown in FIG. 7, and a $^{19}$F NMR spectrum diagram of the product is shown in FIG. 8. Product NMR data: $^1$H NMR (deuterated chloroform ($CDCl_3$), 600 MHz), δ: 8.32 (d, J=7.8 Hz, 1H), 7.64-7.56 (m, 2H), 7.34-7.27 (m, 2H), 6.93 (dd, J=10.2 Hz, 3.0 Hz, 1H), 6.88-6.86 (m, 3H), 6.66 (dd, J=9.6 Hz, 3.0 Hz, 1H), 6.38 (dd, J=9.6 Hz, 1.2 Hz, 1H), 6.23 (dd, J=10.2 Hz, 1.2 Hz, 1H), 3.77 (s, 3H); $^{13}$C NMR ($CDCl_3$, 150 MHz), δ: 184.5, 179.6, 156.2, 155.3, 147.7, 147.6, 137.7, 134.0, 130.8, 130.3, 129.9, 129.3, 128.1, 128.09, 128.0, 123.1, 122.0 (q, J=184.0 Hz), 119.4, 110.7, 55.5, 52.0; and $^{19}$F($CDCl_3$, 564.6 Hz): −59.05.

Embodiment 3

In a reaction tube, biphenyl compound 1c (103.2 mg, 0.3 mmol, 1.0 equiv.), $NaSO_2CF_3$ 2a (140.4 mg, 0.9 mmol, 3.0 equiv.), and $EtNClO_4$ (92 mg, 0.4 mmol, 1.3 equiv.) are accurately added and dissolved in a mixed solvent DCE/MeCN (v/v:1:1, 4 mL) to thereby obtain a mixed solution. An anode is GF with electrode size of 10 mm×15 mm×6 mm, and a cathode is a platinum sheet electrode with an electrode size of 10 mm×15 mm×0.25 mm. An electro-oxidation reaction is performed at 45° C. with a current is kept at 4 mA for 8 hours. The mixed solution after the electro-oxidation reaction is transferred into a round bottom flask. Silicon dioxide is added into the round bottom flask and the solvent is evaporated in vacuo to obtain an evaporated product. Using PE/EA (v/v: 5:1) as an eluent, the evaporated product is purified by silica gel column chromatography to obtain a corresponding product 3ca with a yield of 48%. A reaction formula is as follows:

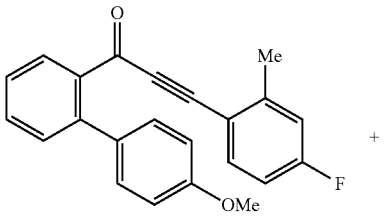

1c

-continued

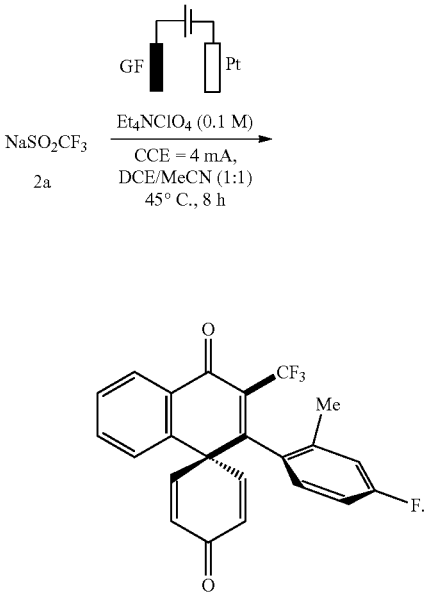

Figure 9:
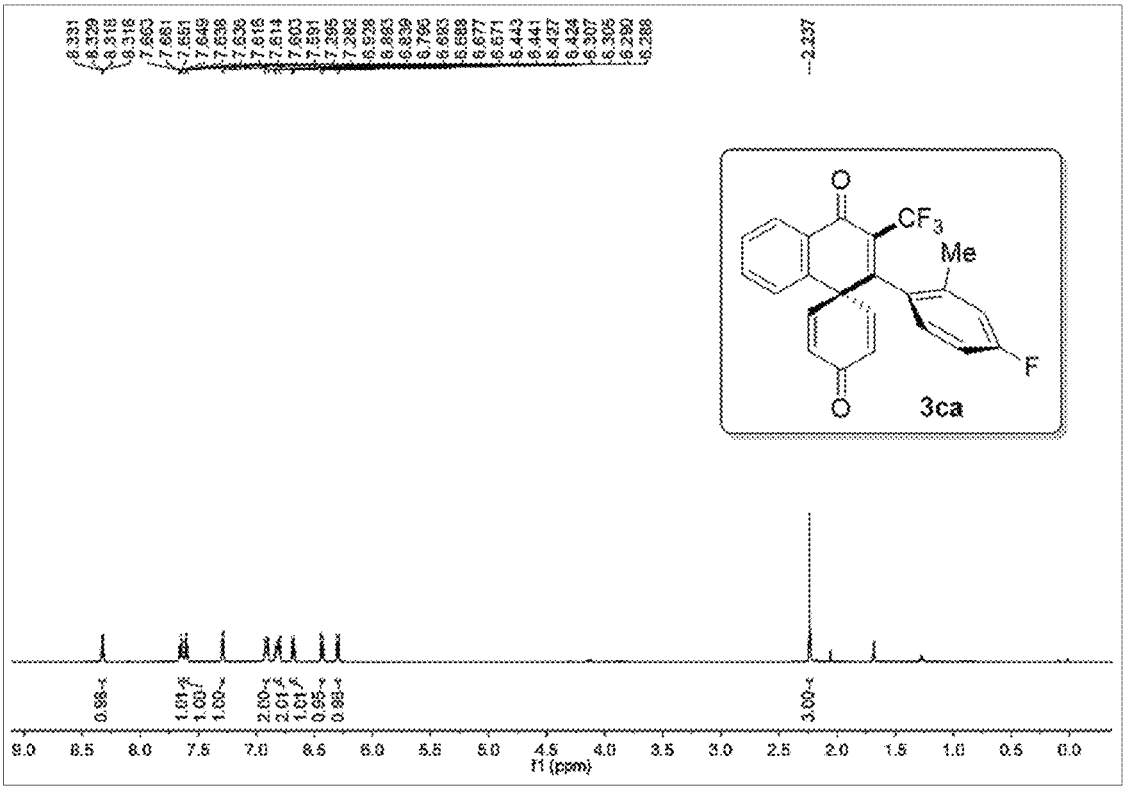
FIG. 9 is a $^1$H NMR spectrum diagram of a product prepared in embodiment 3 of the disclosure.
Figure 10:
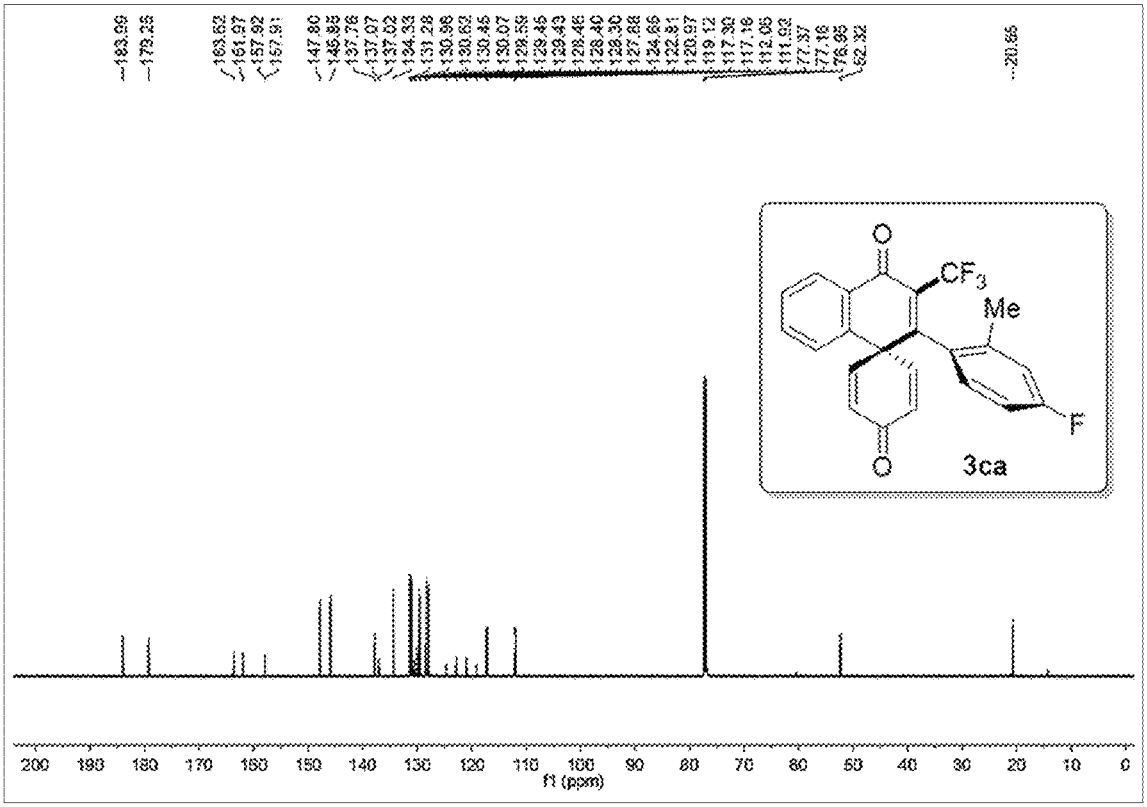
FIG. 10 is a $^{13}$C NMR spectrum diagram of the product prepared in embodiment 3 of the disclosure.
Figure 11:
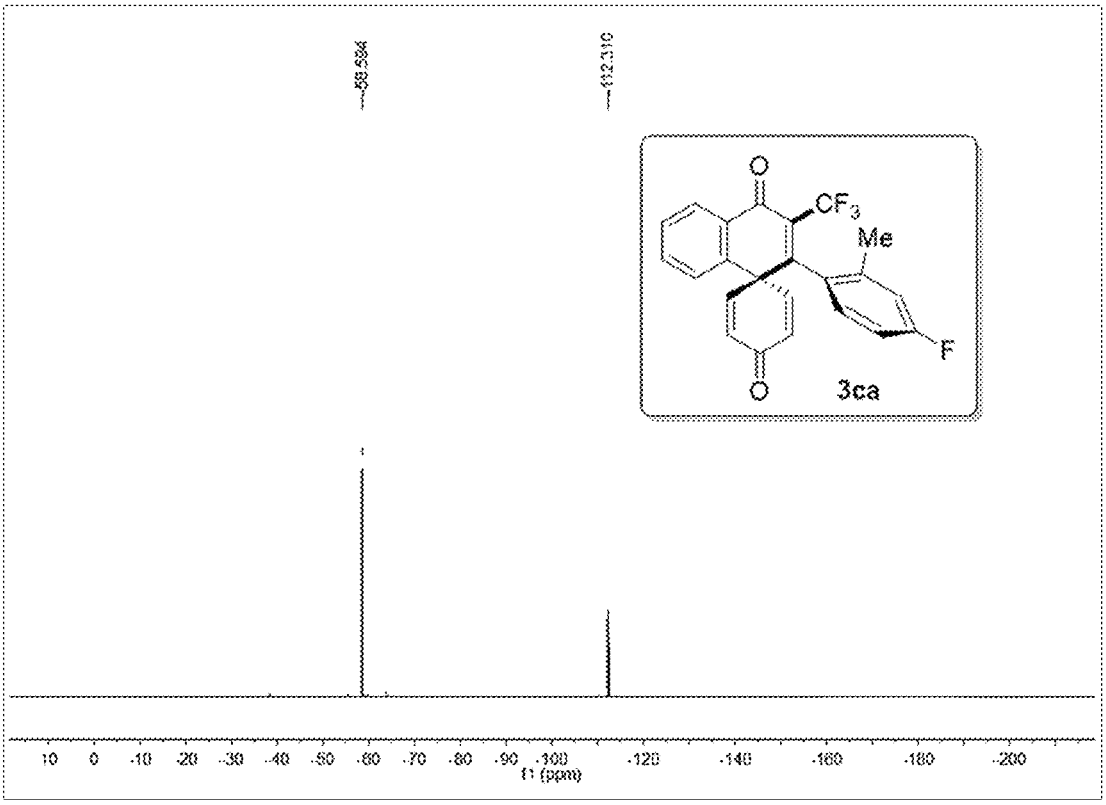
FIG. 11 is a $^{19}$F NMR spectrum diagram of the product prepared in embodiment 3 of the disclosure.

A $^1$H NMR spectrum diagram of the product is shown in FIG. 9, a $^{13}$C NMR spectrum diagram of the product is shown in FIG. 10, and a $^{19}$F NMR spectrum diagram of the product is shown in FIG. 11. Product NMR data: $^1$H NMR (600 MHz, Chloroform-d) δ 8.32 (dd, J=7.8, 1.6 Hz, 1H), 7.65 (td, J=7.6, 1.6 Hz, 1H), 7.60 (dd, J=7.5, 1.3 Hz, 1H), 7.31-7.17 (m, 1H), 7.02-6.87 (m, 2H), 6.82 (ddd, J=13.3, 9.1, 2.8 Hz, 2H), 6.68 (dd, J=9.9, 3.2 Hz, 1H), 6.43 (dd, J=9.9, 1.7 Hz, 1H), 6.30 (dd, J=10.1, 1.7 Hz, 1H), 2.24 (s, 3H); $^{13}$C NMR (151 MHz, Chloroform-d) δ 183.9, 179.1, 163.5, 161.9, 157.8 (d, J=2.4 Hz), 147.7, 145.7, 137.6, 136.9 (d, J=6.8 Hz), 134.2, 131.2, 130.8, 130.4 (q, J=26.9 Hz), 129.5, 128.2, 127.8, 121.8 (q, J=278.0 Hz), 117.1 (d, J=21.6 Hz), 111.9 (d, J=21.9 Hz), 52.2, 20.5; and $^{19}$F NMR (565 MHz, Chloroform-d) δ-58.59, −112.31.

Embodiment 4

In a reaction tube, biphenyl compound 1d (103.2 mg, 0.3 mmol, 1.0 equiv.), $NaSO_2CF_2H$ 2b (120 mg, 0.9 mmol, 3.0 equiv.), and $EtNClO_4$ (92 mg, 0.4 mmol, 1.3 equiv.) are accurately added and dissolved in a mixed solvent DCE/MeCN (1:1, 4 mL) to thereby obtain a mixed solution. An anode is GF with an electrode size of 10 mm×15 mm×6 mm, and a cathode is a platinum sheet electrode with an electrode size of 10 mm×15 mm×0.25 mm. An electro-oxidation reaction is carried out at 45° C. and a current is kept at 4 mA for 8 hours. The mixed solution after the electro-oxidation reaction is transferred into a round bottom flask. Silicon dioxide is added into the round bottom flask and the solvent is evaporated in vacuo to obtain an evaporated product. Using PE/EA (v/v: 5:1) as an eluent, the evaporated product is purified by silica gel column chromatography to obtain a corresponding product 3db with a yield of 52%. A reaction formula is as follows:

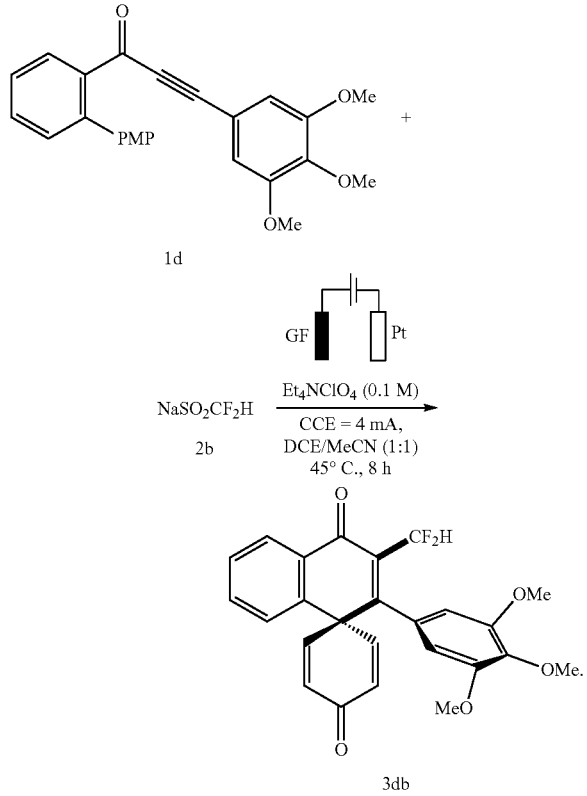

Figure 12:
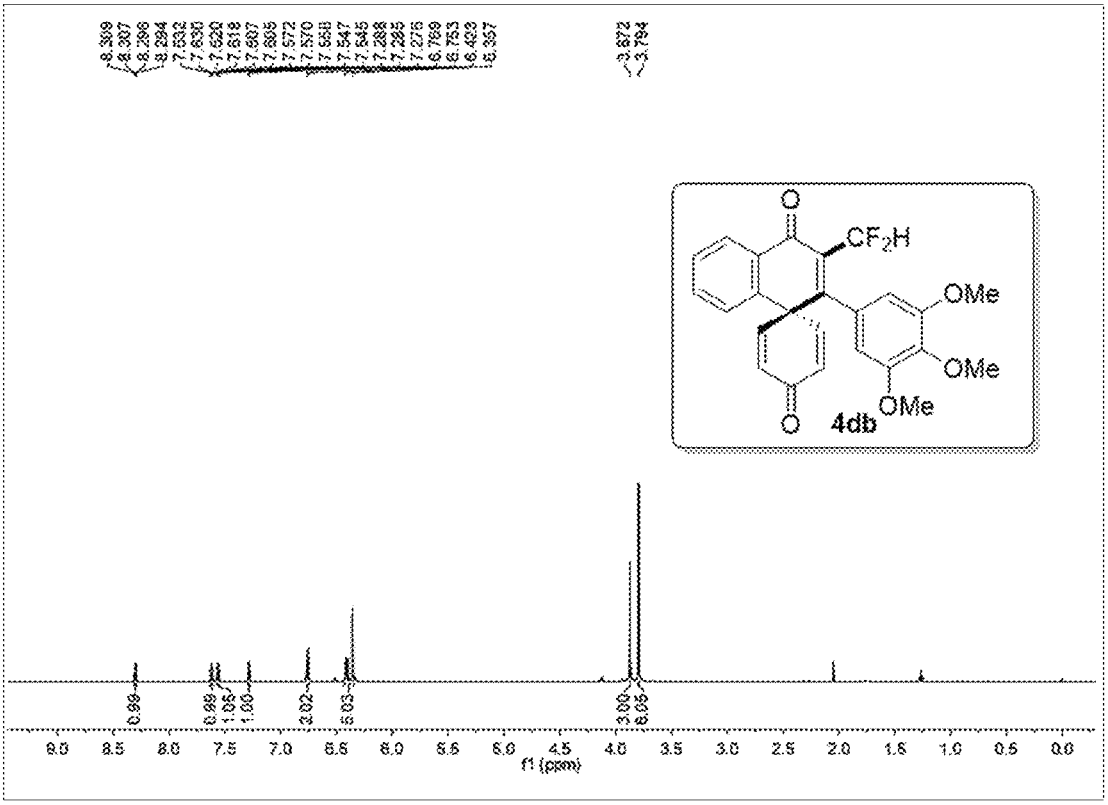
FIG. 12 is a $^1$H NMR spectrum diagram of a product prepared in embodiment 4 of the disclosure.
Figure 13:
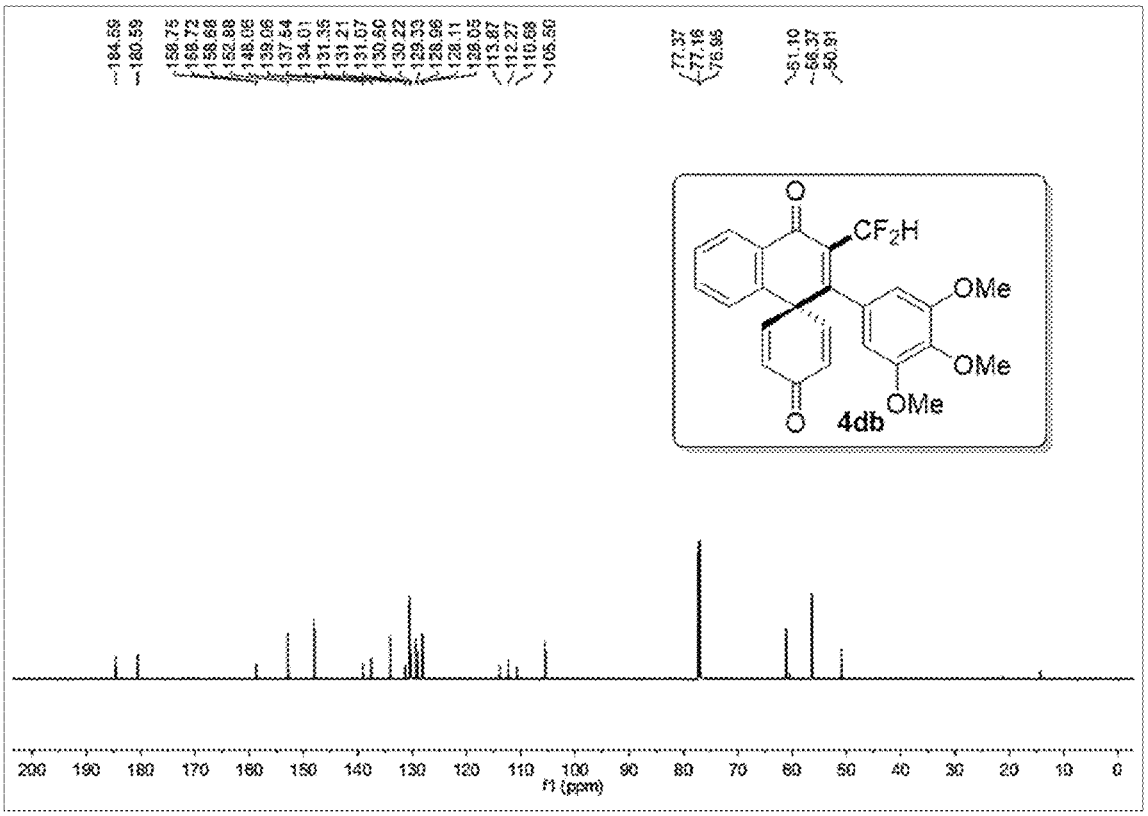
FIG. 13 is a $^{13}$C NMR spectrum diagram of the product prepared in embodiment 4 of the disclosure.
Figure 14:
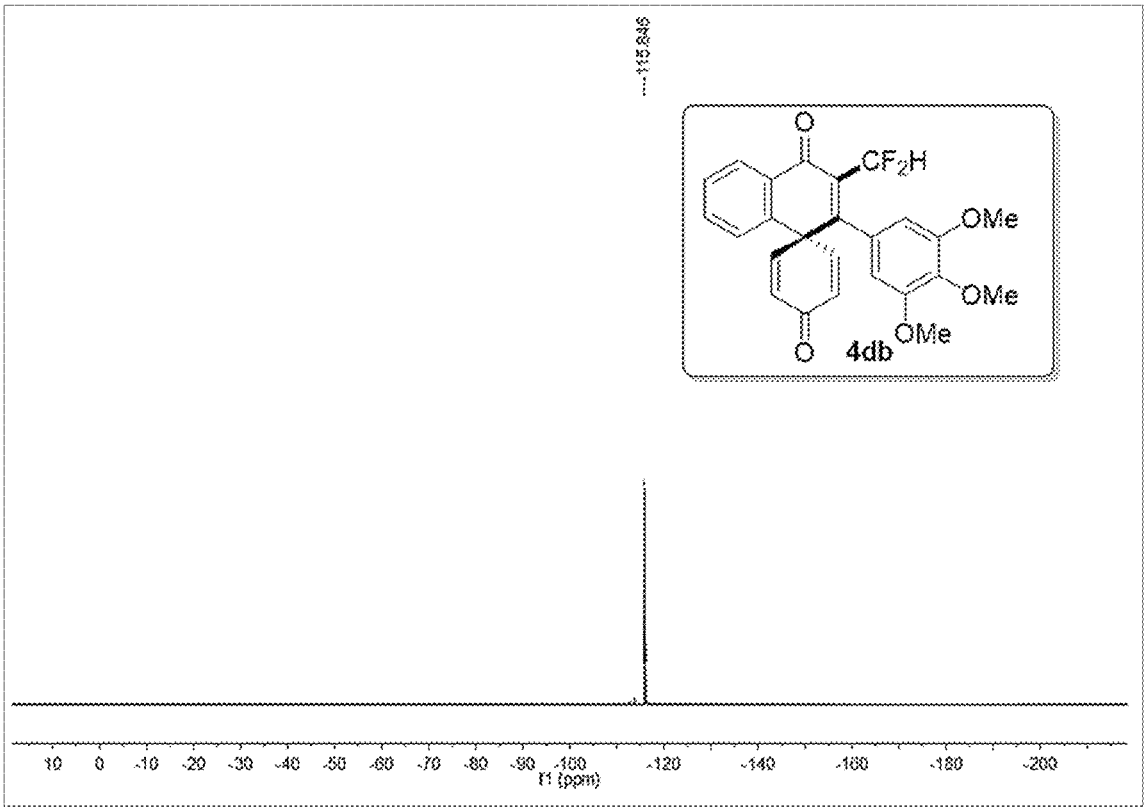
FIG. 14 is a $^{19}$F NMR spectrum diagram of the product prepared in embodiment 4 of the disclosure.

A $^1$H NMR spectrum diagram of the product is shown in FIG. 12, a $^{13}$C NMR spectrum diagram of the product is shown in FIG. 13, and a $^{19}$F NMR spectrum diagram of the product is shown in FIG. 14. Product NMR data: $^1$H NMR (600 MHz, Chloroform-d) δ 8.30 (dd, J=7.9, 1.5 Hz, 1H), 7.62 (td, J=7.5, 1.5 Hz, 1H), 7.56 (td, J=7.5, 1.1 Hz, 1H), 7.37-7.21 (m, 1H), 6.81-6.69 (m, 2H), 6.57-6.16 (m, 5H), 3.87 (s, 3H), 3.79 (s, 6H); $^{13}$C NMR (151 MHz, Chloroform-d) δ 184.5, 180.5, 158.3 (t, J=5.3 Hz), 152.8, 148.0, 139.0, 137.5, 133.9, 131.1 (t, J=20.8 Hz), 130.4, 130.1, 129.3, 128.9, 128.0, 128.0, 112.2 (t, J=240.3 Hz), 105.4, 50.0, 56.8; and $^{19}$F NMR (565 MHz, Chloroform-d) δ-115.85.

The above is only illustrated embodiments of the disclosure and is not intended to limit the disclosure. Any modifications, equivalent replacements and changes made within the spirit and principles of the disclosure shall be included in the protection scope of the disclosure.

What is claimed is:

1. A method for preparing a compound with a spiro[5.5] molecular skeleton by electrooxidation, comprising:

reacting o-alkynyl benzoyl biphenyl with sodium fluoromethylsulfite in an electrolyte and a solvent under a current condition to thereby obtain the compound with the spiro[5.5] molecular skeleton;

wherein the solvent is at least one selected from the group consisting of acetonitrile ($C_2H_3N$), dichloroethane ($C_2H_4Cl_2$), methanol ($CH_4O$), isopropanol ($C_3H_8O$), ethyl acetate ($C_4H_8O_2$), N, N-dimethylformamide ($C_3H_7NO$) and tetrahydrofuran ($C_4H_8O$);

wherein a structural formula of the o-alkynyl benzoyl biphenyl is shown in a formula (I), and a structural formula of the sodium fluoromethylsulfite is shown in a formula (II);

(I)

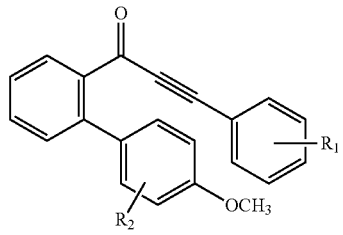

(II)

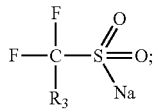

where in the formula (I), R1 is one of an electron-withdrawing group and an electron-donating group, R2 is one of a methyl group and a methoxy group;

wherein in the formula (II), R3 is one of a hydrogen group and a fluorine group.

2. The method according to claim 1, wherein the electron-withdrawing group is one selected from the group consisting of a hydrogen group, a nitro group, halogen groups, a cyano group, an acyl group and a carboxyl group; and the electron-donating group is one selected from the group consisting of a hydrogen group, an amino group, a methyl group and a methoxy group.

3. The method according to claim 1, wherein substitution positions of the R1 are any two or more positions selected from the group consisting of positions 2, 3, 4, 5 and 6 of a benzene ring; and substitution positions of R2 is at positions 3 and 5 of another benzene ring.

4. The method according to claim 1, wherein the electrolyte is one selected from the group consisting of tetrabutyl ammonium tetrafluoroborate ($C_{16}H_{36}BF_4N$), lithium tert-butoxide ($C_4H_9LiO$), tetrabutylammonium periodate ($C_{16}H_{36}INO_4$), N,N,N-triethylethanaminium perchlorate ($C_8H_{20}ClNO_4$), tetraethylammonium hexafluorophosphate ($C_8H_{20}F_6NP$) and tetrabutylammonium perchlorate ($C_{16}H_{36}ClNO_4$), and a concentration of the electrolyte in the solvent is in a range of 0.05~1 mole per liter (mol/L); and a molar ratio of the o-alkyne benzoyl biphenyl to the sodium fluoromethylsulfite is 1:3.

5. The method according to claim 4, wherein the electrolyte is the N,N,N-triethylethanaminium perchlorate, a concentration of the N,N,N-triethylethanaminium perchlorate in the solvent is 0.1 mol/L, and the solvent is a mixture of the dichloroethane and the acetonitrile with a volume ratio of 1:1.

6. The method according to claim 1, wherein a reaction condition of the reacting the o-alkynyl benzoyl biphenyl with the sodium fluoromethylsulfite in the electrolyte and the solvent under the current condition comprises:

graphite felt as an anode material, a platinum sheet or a nickel foam as a cathode material, a constant current in a range of 3~10 milliamperes (mA), a reaction temperature in a range of 25~70° C., and a reaction time in a range of 7~11 hours.

7. The method according to claim 6, wherein the reaction condition specifically comprises:

the graphite felt as the anode material, the platinum sheet as the cathode material, the constant current of 4 mA, the reaction temperature of 45° C., and the reaction time of 8 hours.

8. The method according to claim 1, wherein the reacting is carried out in an open system without a catalyst.

* * * * *